US007112105B2

(12) United States Patent
Wu

(10) Patent No.: US 7,112,105 B2
(45) Date of Patent: Sep. 26, 2006

(54) CABLE ASSEMBLY HAVING POWER CONTACTS

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 361 days.

(21) Appl. No.: 10/625,649

(22) Filed: Jul. 22, 2003

(65) Prior Publication Data

US 2005/0266739 A1 Dec. 1, 2005

(51) Int. Cl.
*H01R 13/40* (2006.01)

(52) U.S. Cl. ..... 439/752.5; 439/746; 439/872

(58) Field of Classification Search ..... 439/746–749, 439/752.5, 871–872, 851–857, 861, 595, 439/382, 891, 680

See application file for complete search history.

(56) References Cited

U.S. PATENT DOCUMENTS 3,964,815 A 6/1976 McDonough
5,102,354 A 4/1992 Crane et al.
5,295,871 A * 3/1994 Lapraik et al. ..... 439/746
5,362,260 A * 11/1994 Peloza ..... 439/746
5,664,326 A * 9/1997 Ohsumi ..... 29/874
5,664,969 A * 9/1997 Peterson et al. ..... 439/746
5,681,190 A * 10/1997 Childs ..... 439/856
5,993,268 A * 11/1999 Yamaguchi ..... 439/752.5
6,375,501 B1 * 4/2002 Kojima ..... 439/595
6,905,373 B1 * 6/2005 Wu ..... 439/746

* cited by examiner

*Primary Examiner*—Truc T. Nguyen
*Assistant Examiner*—Edwin A. Leon
(74) *Attorney, Agent, or Firm*—Wei Te Chung

(57) ABSTRACT

A cable assembly (1) includes an insulating housing (4) receiving a number of contacts (5) therein and a number of cables (3) terminated to corresponding contacts. Each contact includes an intermediate portion (50), a central contact beam (52) extending upwardly and rearwardly from the intermediate portion, a pair of side contact beams (54) extending upwardly from two opposite sides (502) of the intermediate portion and a tail portion (56) extending rearwardly from the intermediate portion. The central contact beam has a contacting portion (522) at a free end thereof. The side contact beams include a pair of vertical arms (540) located at opposite sides of the central contact beam and a pair of resilient side arms (542) extending rearwardly from the vertical arms.

6 Claims, 12 Drawing Sheets

CABLE ASSEMBLY HAVING POWER CONTACTS

CROSS-REFERENCE TO RELATED APPLICATIONS

Relevant subject matter is disclosed in co-pending U.S. patent application Ser. No. 10/617,575 filed Jul. 11, 2003 and entitled "ELECTRICAL CONTACT FOR CABLE ASSEMBLY", which is invented by the same inventor as this patent application and assigned to the same assignee with this application.

BACKGROUND OF THE INVENTION

1. Field of the Invention

The present invention relates to a cable assembly, and particularly to a cable assembly having improved contacts for ensuring a reliable connection with complementary contacts.

2. Description of Related Art

Electrical connectors are widely used in electronic systems for establishing an electrical connection between two electronic devices thereof. Some electronic devices, such as servers, are equipped with power connectors for carrying power. These power connectors generally comprise two mating halves, i.e., a plug connector connecting with a circuit substrate and a receptacle cable assembly connecting with a power supply system for supplying power to the circuit substrate. The receptacle cable assembly generally comprises a unitarily molded insulating housing, a plurality of socket-type power contacts retained in the housing, and a plurality of cables terminated to corresponding power contacts. Such a socket-type power contact can be referred to U.S. Pat. No. 3,964,815. Once the socket-type contacts engage with corresponding pin-type contacts of the plug connector, a mechanical and electrical connection is established between the plug connector and the receptacle cable assembly. However, in some particular circumstances where high shock or vibration exists, the connection of the plug contact and the receptacle contact is easy to become loose. This results in an unreliable electrical connection between the plug connector and the receptacle cable assembly.

U.S. Pat. No. 5,102,354, issued to Crane et al., discloses a receptacle cable assembly having receptacle contacts to solve the above-mentioned problem. Each receptacle contact includes a front contact portion, a rear cable gripping portion and an intermediate portion interconnecting the contact portion with the gripping portion. The contact portion has a central contact beam extending upwardly and rearwardly from a front end of the intermediate portion to form a curved contact section above the intermediate portion, and a pair of side contact beams integrally and upwardly extending from two opposite sides of the central contact beam. When the receptacle cable assembly engages with a complementary plug connector, a plug contact of the complementary plug connector electrically contacts with the side contact beams and the curved contact section of the central contact beam to achieve multiple contact points therebetween. However, since the side contact beams integrally extend from the central contact beam, the side contact beams would move downward with the resiliently downward deformation of the central contact beam during the insertion of the plug contact, whereby a vertical wipe friction occurs between the plug contact and the side contact beams. After repeated insertion of the plug contact, the outside conductive material, such as gold, coated on the plug contact and the side contact beams of the receptacle contact may fall off, thereby adversely affecting the electrical connection between the plug contact and the receptacle contact. On the other hand, the side contact beams are easy to rotate with the deformation of the central contact beam, thereby increasing the difficulty of ensuring a reliable engagement between the plug contact and the receptacle contact.

Hence, an improved electrical contact for a cable assembly is required to overcome the disadvantages of the related art.

SUMMARY OF THE INVENTION

Accordingly, an object of the present invention is to provide a cable assembly having improved electrical contacts for ensuring a reliable connection with a complementary contact.

In order to achieve the object set forth, a cable assembly in accordance with the present invention comprises an insulating housing defining a plurality of cavities, a plurality of contacts received in corresponding cavities of the housing and a plurality of cables terminated to the corresponding contacts. Each contact comprises an intermediate portion, a central contact beam extending upwardly and rearwardly from the intermediate portion, a pair of side contact beams extending upwardly from two opposite sides of the intermediate portion and a tail portion extending rearwardly from the intermediate portion and terminated to a corresponding cable. The central contact beam has a contacting portion at a free end thereof. The side contact beams comprise a pair of vertical arms located at opposite sides of the central contact beam and a pair of resilient side arms extending rearwardly from the vertical arms.

Other objects, advantages and novel features of the invention will become more apparent from the following detailed description when taken in conjunction with the accompanying drawings.

DETAILED DESCRIPTION OF THE PREFERRED EMBODIMENT

Figure 1:
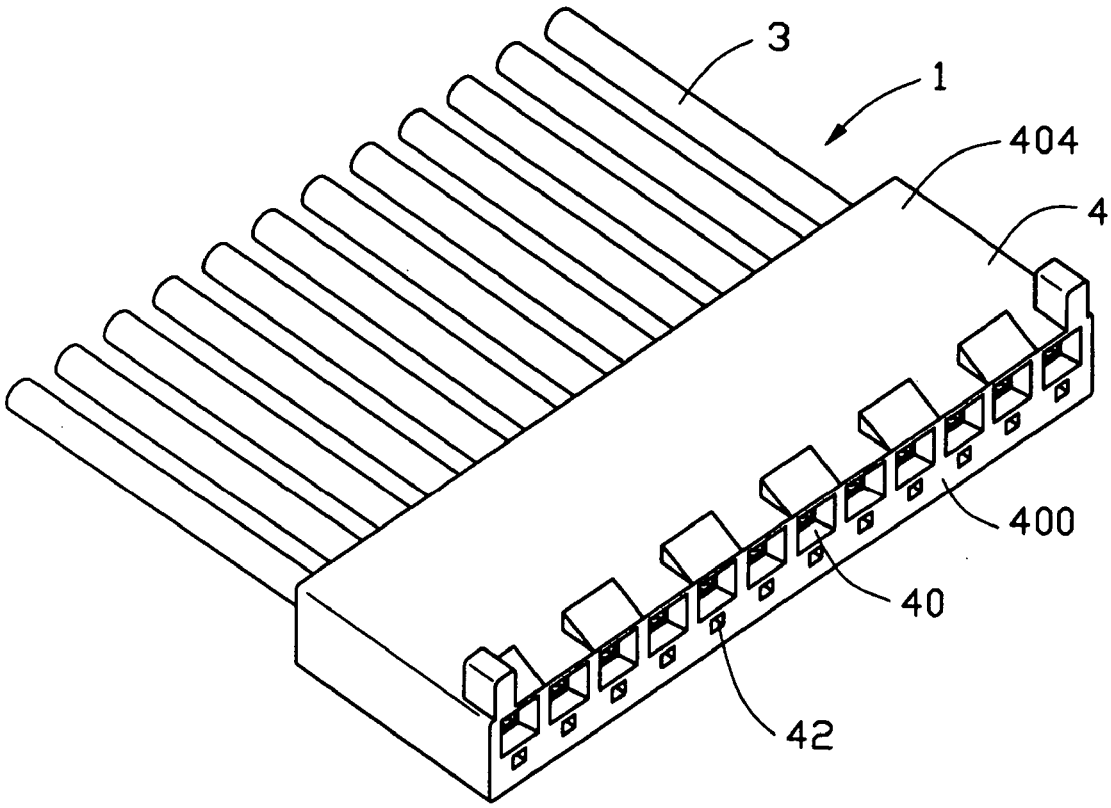
FIG. 1 is an assembled perspective view of a cable assembly in accordance with the present invention.
Figure 2:
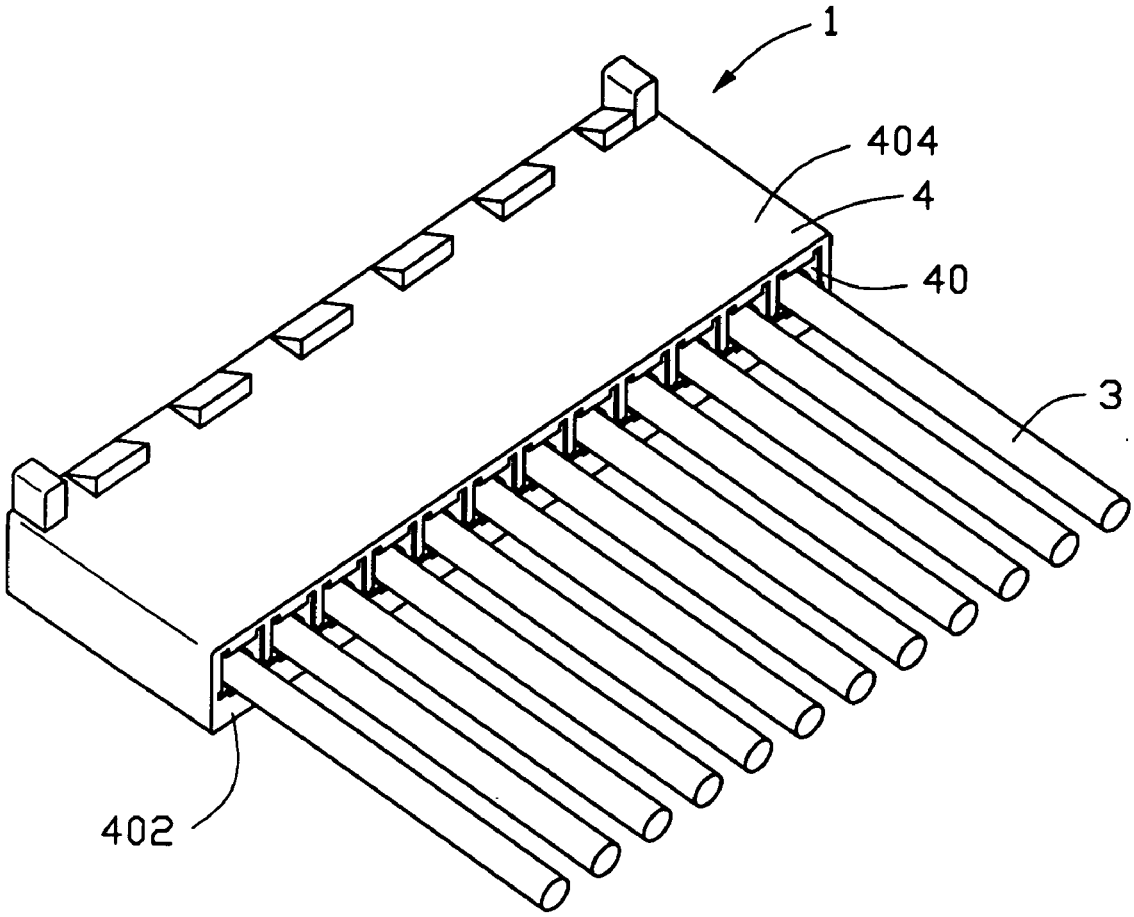
FIG. 2 is a view similar to FIG. 1 but taken from a different perspective.
Figure 3:
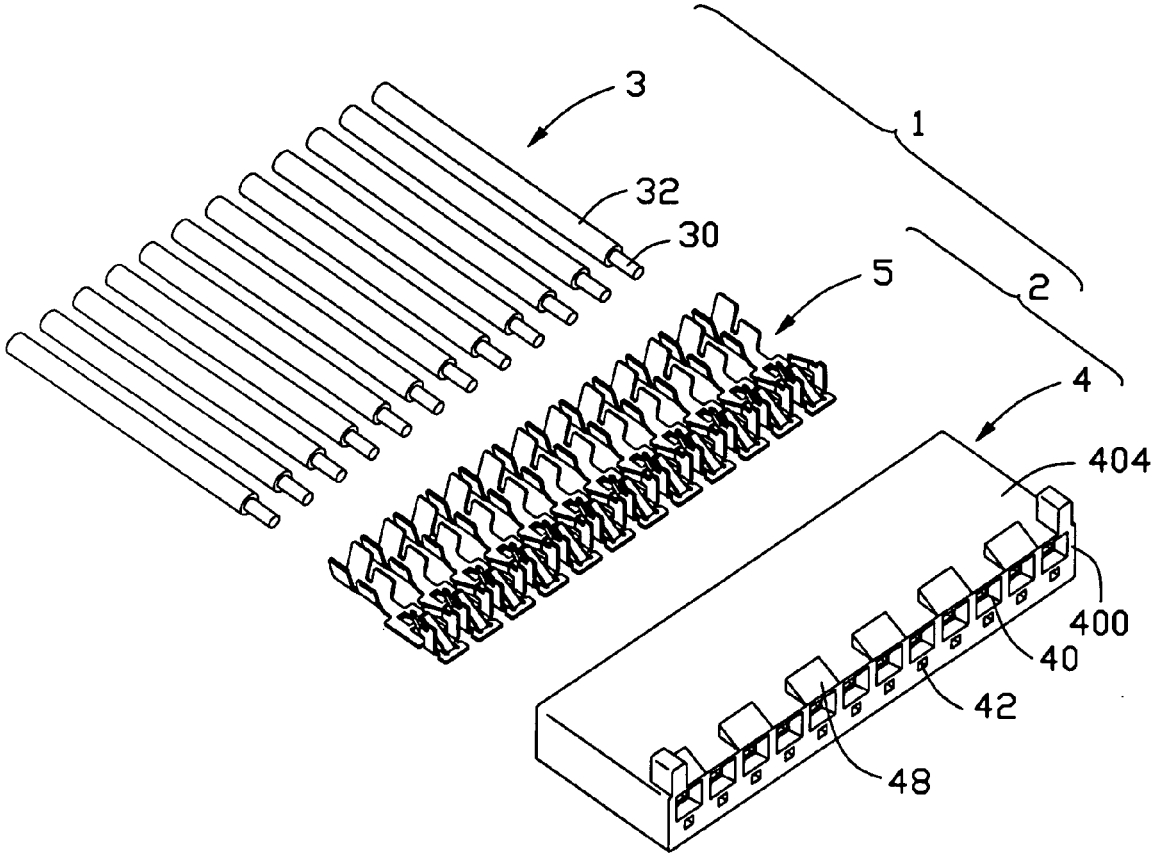
FIG. 3 is an exploded view of the cable assembly shown in FIG. 1.

Reference will now be made in detail to the preferred embodiment of the present invention.

Referring to FIGS. 1–4, a cable assembly 1 in accordance with the present invention comprises a receptacle connector 2 and a plurality of cables 3 electrically connecting with the receptacle connector 2. Each cable 3 includes an inner conductive core 30 and an outer insulator 32 surrounding the inner conductive core 30. The conductive core 30 is exposed outside at one end of the cable 3.

Figure 4:
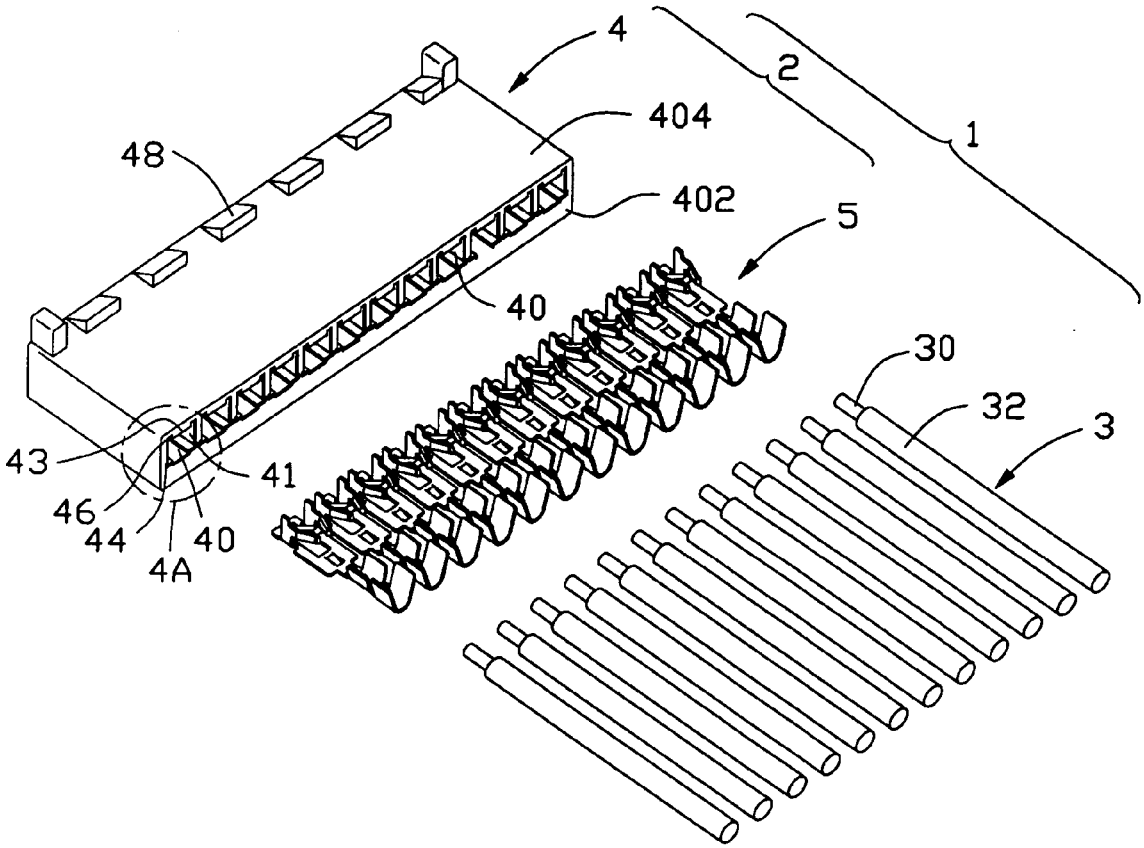
FIG. 4 is an exploded view of the cable assembly shown in FIG. 2.
Figure 4A:
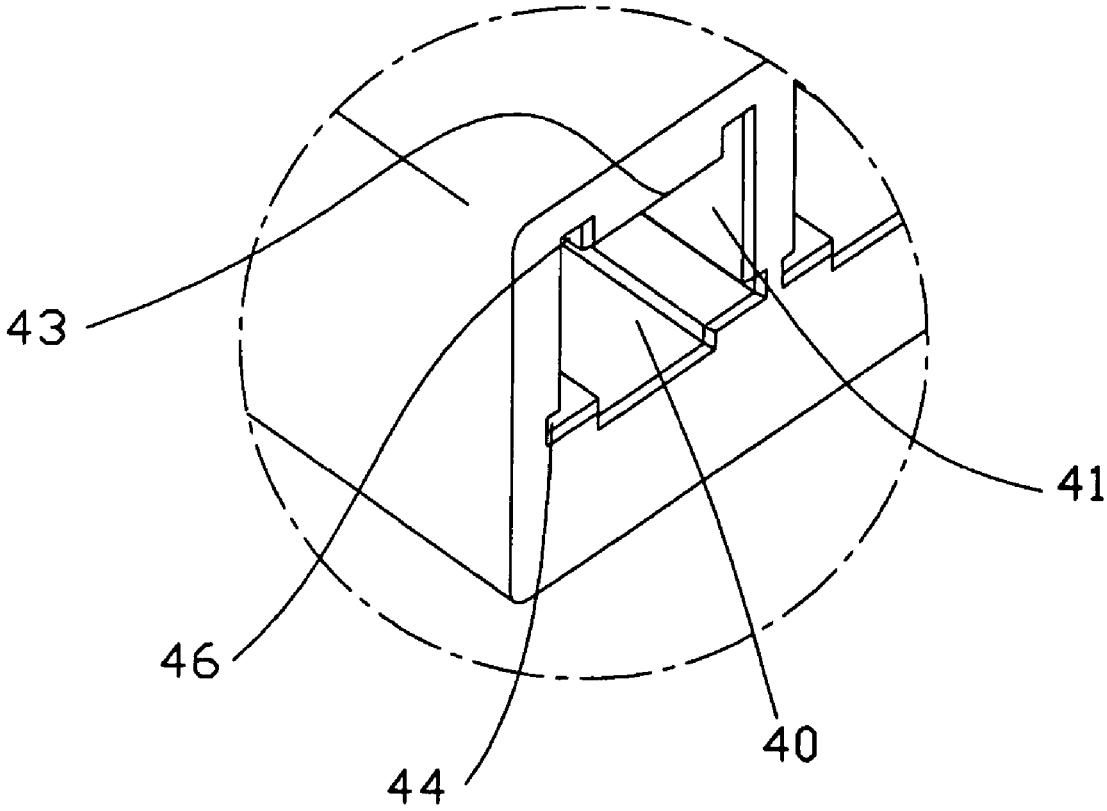
FIG. 4A is an enlarged view of a circled portion of FIG. 4 indicated by reference number 4A.
Figure 8:
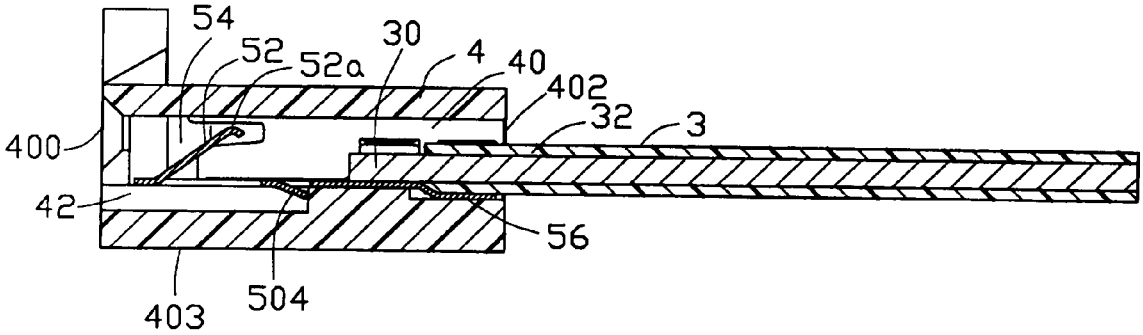
Figure 9:
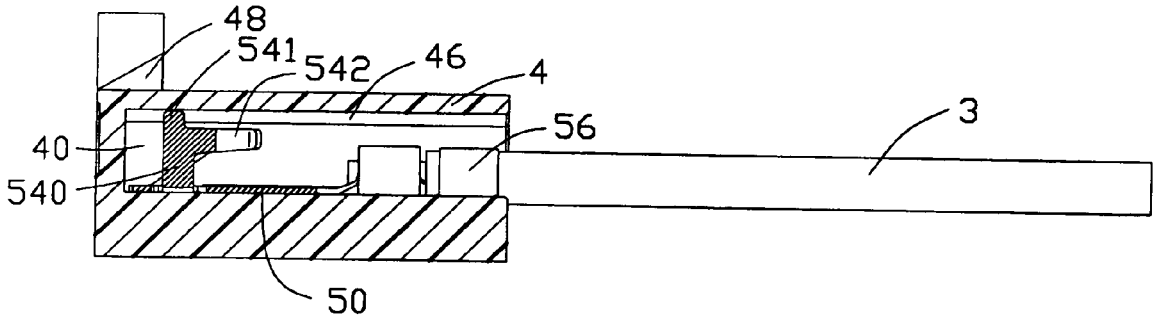
Figure 10:
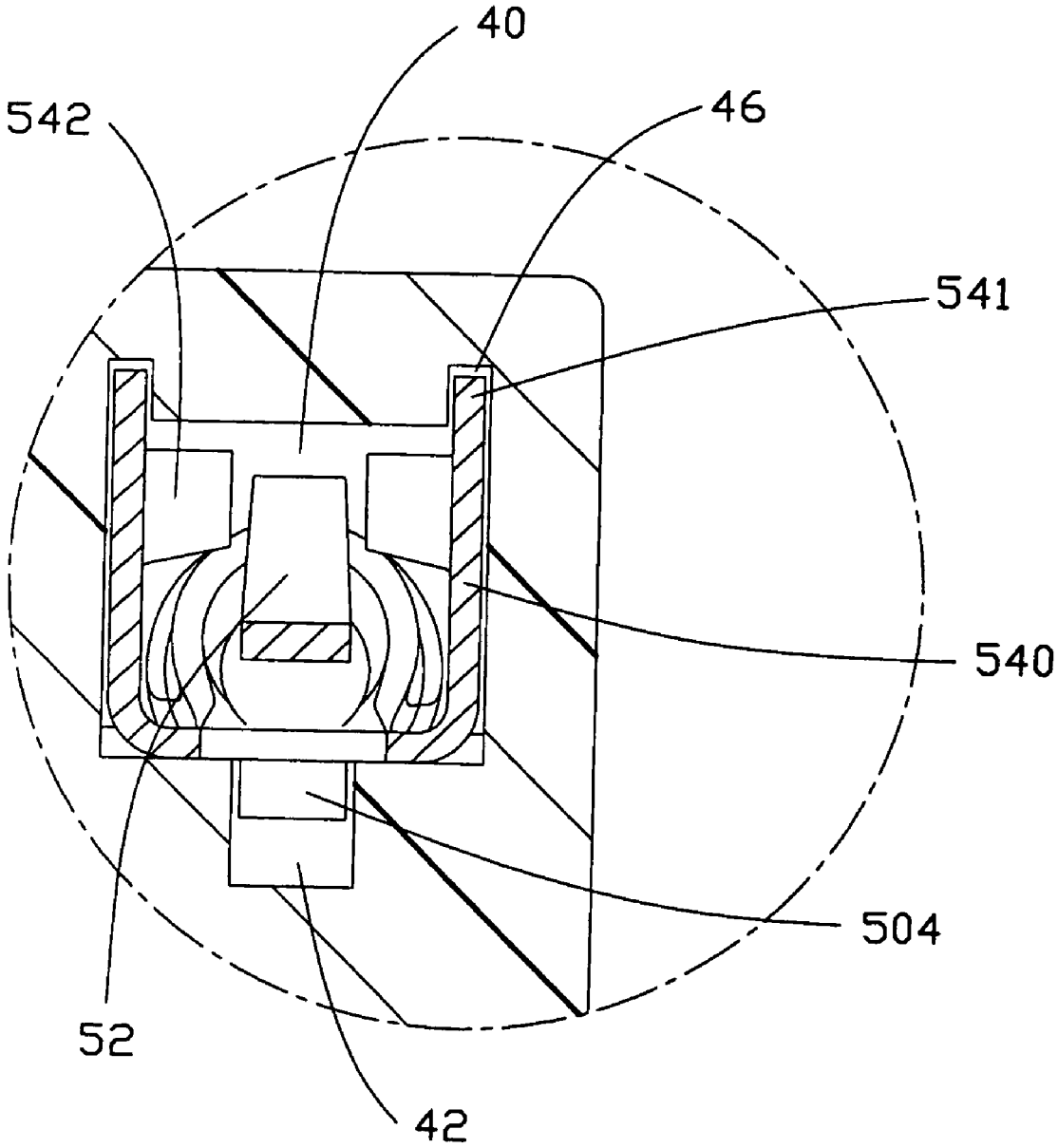
FIG. 10 is an enlarged, partial cross-section view of the cable assembly, showing vertical ribs of contacts received in corresponding channels of an insulating housing of the present invention.
Figure 11:
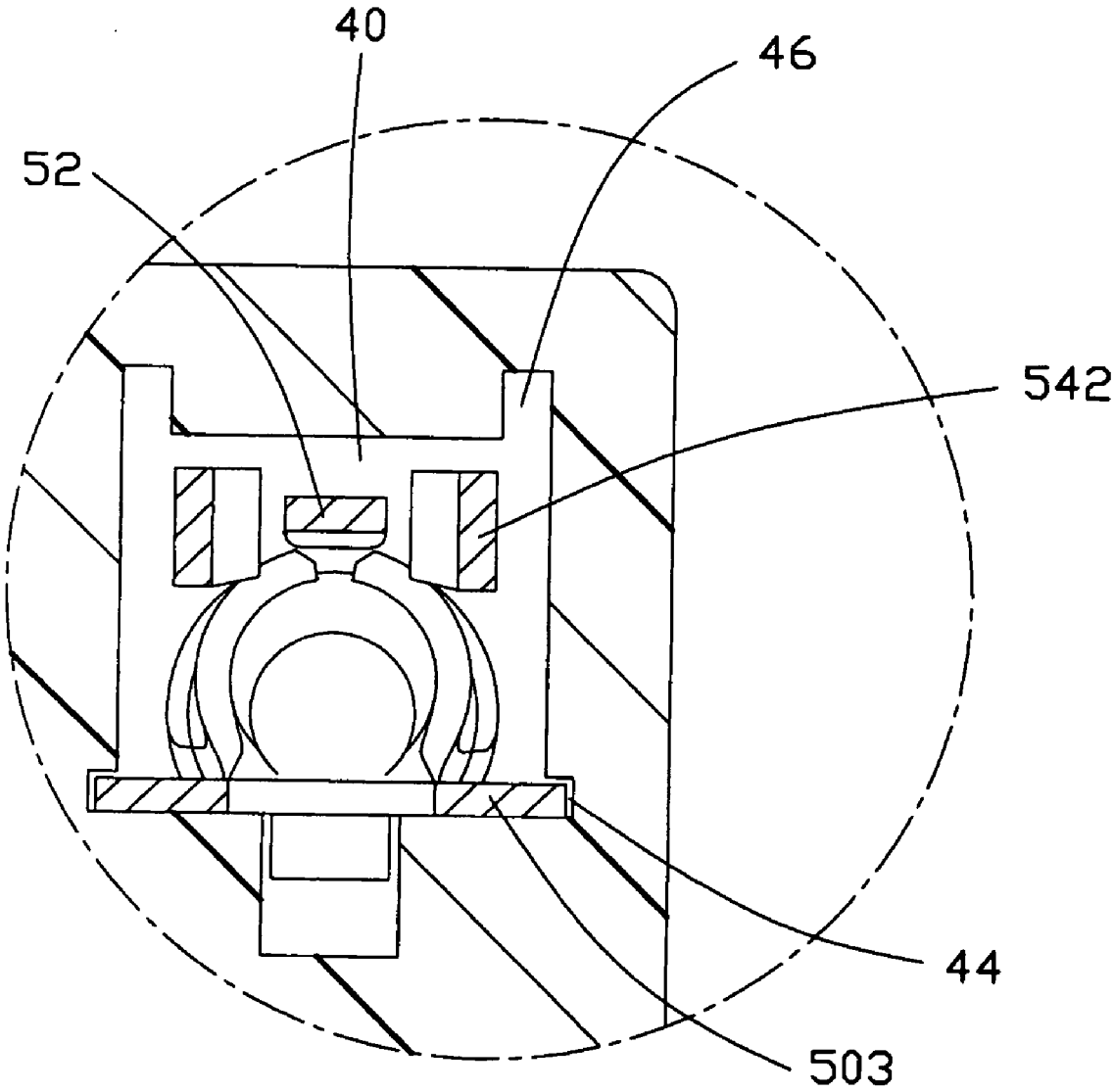
FIG. 11 is an enlarged, partial cross-section view of the cable assembly, showing an intermediate portion of the contact received in corresponding slits of the housing of the present invention.

The receptacle connector 2 includes a rectangular insulating housing 4 and a plurality of contacts 5 received in the housing 4. The housing 4 has a front face 400 and an opposite rear face 402. The housing 4 defines a plurality of cavities 40 extending through the front face 400 and the opposite rear face 402 along a lateral direction thereof and a corresponding number of slots 42 exposed to the front face 400 while not exposed to a bottom 403 (FIG. 8) of the housing 4. The slots 42 communicate with corresponding cavities 40. As clearly shown in FIG. 4A, each cavity 40 is further recessed outwardly from opposite inner sides 41 thereof to form a pair of slits 44 at lower comers thereof and is further recessed upwardly from a top face 43 thereof to form a pair of channels 46 at upper corners thereof. A plurality of latching bosses 48 is formed on a top 404 of the housing 4 adapted to be received in a corresponding latching slot of a complementary connector (not shown).

Figure 5:
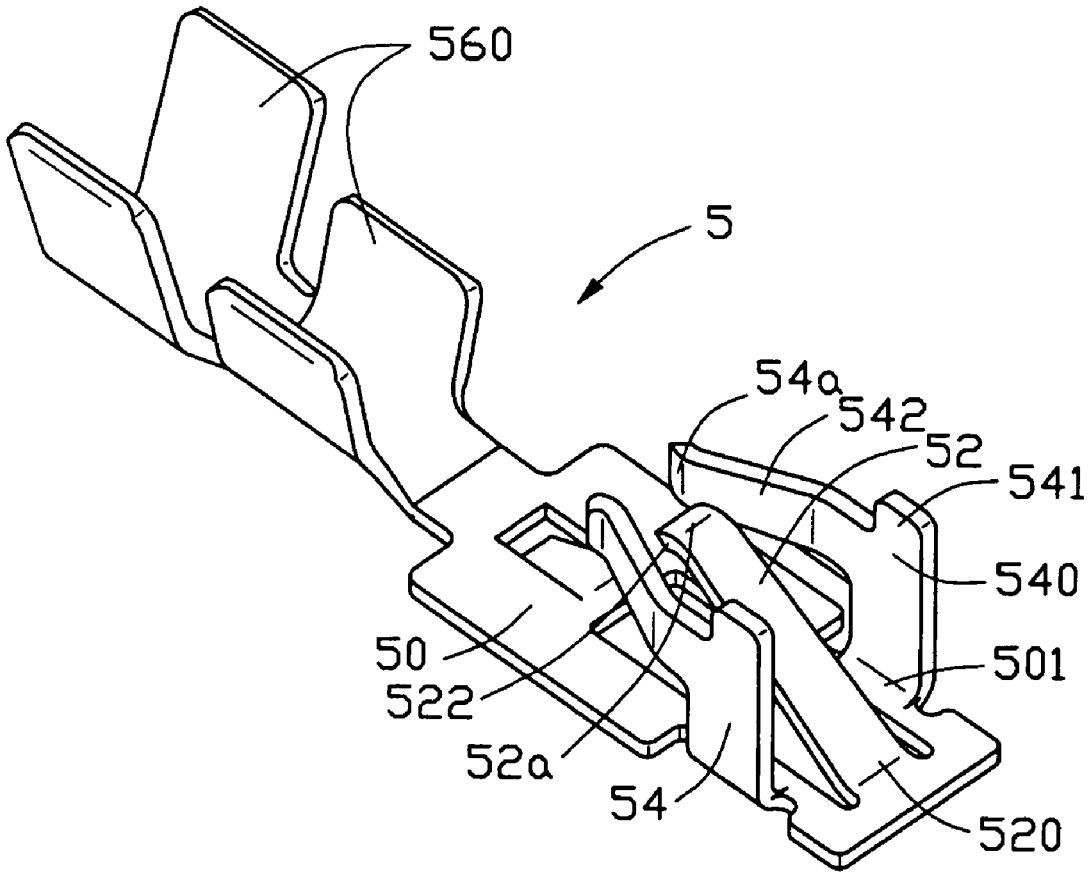
FIG. 5 is an enlarged perspective view of an electrical contact used in the cable assembly.
Figure 6:
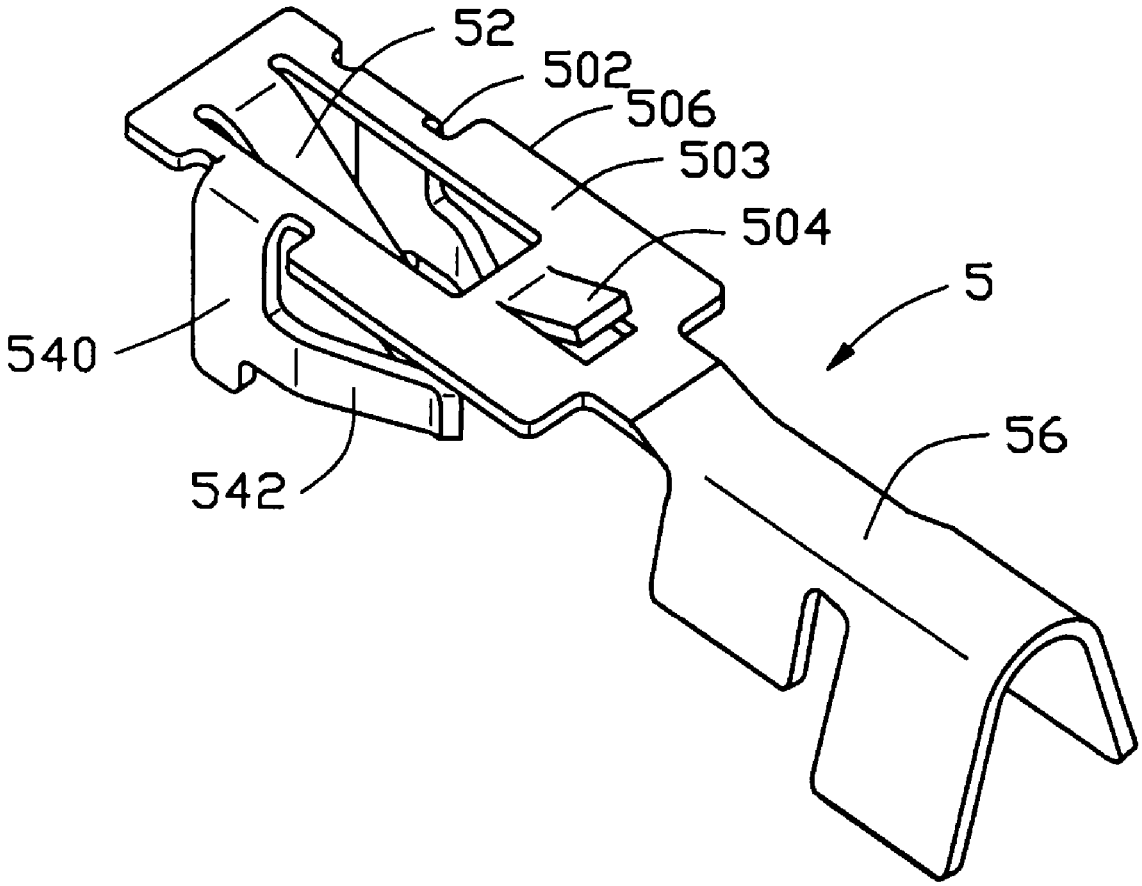
FIG. 6 is a view similar to FIG. 5 but taken from a different perspective.
Figure 7:
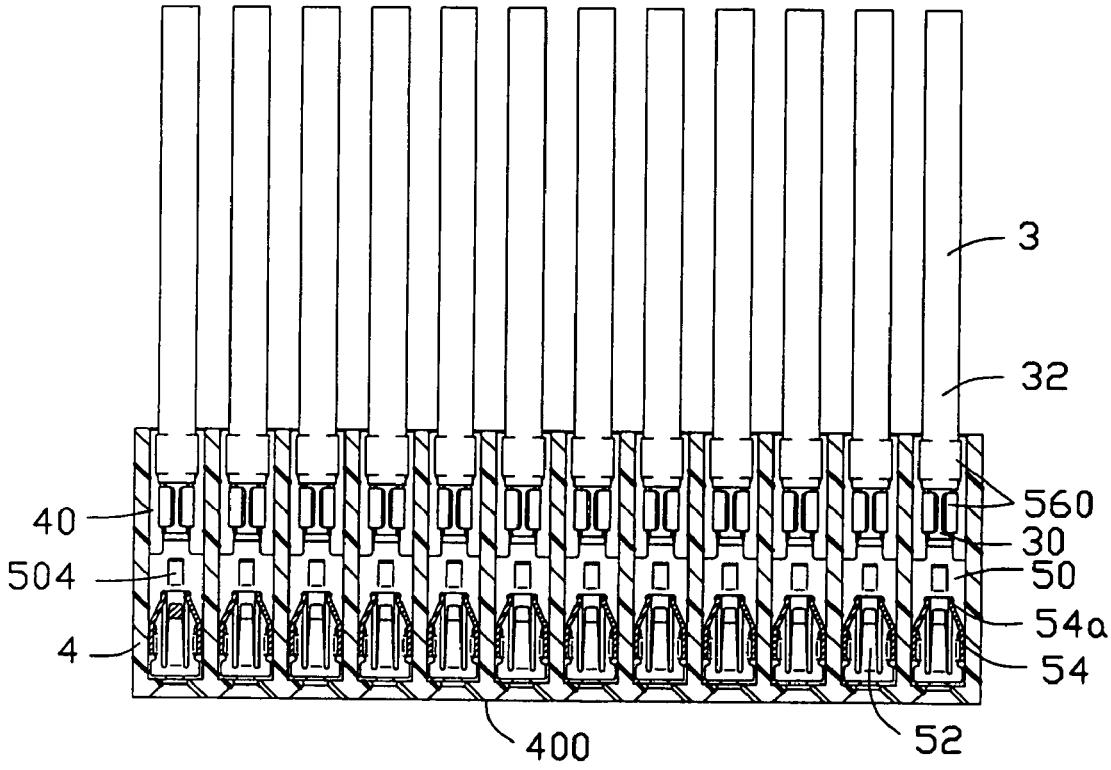
FIGS. 7–9 are cross-section views taken from different sections of the cable assembly shown in FIG. 1.

Each one of the contacts 5 is identical in structure and an exemplary one thereof is shown in FIGS. 5 and 6. Each contact 5 is formed from a conductive material and includes a planar intermediate portion 50 having a front section 501 and a rear section 503, a central contact beam 52 extending upwardly from the intermediate portion 50, a pair of side contact beams 54 extending upwardly from two opposite sides 502 of the front section 501 and a tail portion 56 extending rearwardly from a rear end of the rear section 503 to electrically connect with a corresponding cable 3. The rear section 503 has a tab 504 extending downwardly and rearwardly therefrom.

The central contact beam 52 is punched out of the intermediate portion 50 and extends rearwardly from the front section 501 to the rear section 503. The central contact beam 52 has a connecting portion 520 connecting with the intermediate portion 50 and a contacting portion 522 with a curved surface 52*a* located above the rear section 503. The central contact beam 52 deforms downwardly about the connecting portion 520 to achieve an electrical contact between the curved contact surface 52*a* and a complementary contact of the complementary connector.

The side contact beams 54 include a pair of vertical arms 540 and a pair of resilient side arms 542 extending rearwardly from the vertical arms 540. The vertical arms 540 have a pair of ribs 541 at top ends thereof. The side arms 542 have a pair of connecting portions 54*a* projecting toward each other at free ends thereof for electrically contacting with the complementary contact.

In the preferred embodiment, the tail portion 56 has two pairs of gripping wings 560 adapted to extend and wrap around the corresponding cable 3 by means of a crimp tool (not shown).

Referring to FIGS. 7–11, each contact 5 is crimped to a corresponding cable 3 with gripping wings 560 surroundingly engaging outside surfaces of the exposed conductive core 30 and the outer insulator 32. Each contact 5 with a corresponding cable 3 electrically connecting thereto is then inserted into a corresponding cavity 40 of the housing 4 from the rear face 402. The rear section 503 of the intermediate portion 50 has opposite side edges 506 received in a corresponding pair of slits 44 to prevent the contact 5 from moving upwardly and forwardly. The slits 44 can also function as guiding slits during the insertion of the contact 5 into the cavity 40. The tab 504 of the intermediate portion 50 is received in the corresponding slot 42 of the housing 4 for preventing the contact 5 from moving rearwardly. The ribs 541 of the vertical arms 540 are received in a corresponding pair of channels 46 to prevent the side contact beams 54 from rotating. The cable assembly 1 of the present invention is thus formed.

When the cable assembly 1 mates with the complementary connector, the complementary contact simultaneously contacts with the curved surface 52*a* and the connecting portions 54*a* of a corresponding contact 5 to achieve multiple contacting points therebetween. It is noted that the side contact beams 54 do not move or rotate with the deformation of the central contact beam 52 during the insertion of the complementary contact since the side contact beams 54 integrally extend from the intermediate portion 50 and have ribs 541 received in the channels 46 of the housing 4. Thus, a reliable engagement is ensured between the contact 5 and the complementary contact.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing defining a plurality of cavities extending therethrough in a front-to-back direction;

plural pairs of vertical channels extending forwardly from a rear face of the housing and in communication with the corresponding cavities, respectively;

plural pairs of horizontal slits extending forwardly from the rear face of the housing and in communication with the corresponding cavities, respectively;

a plurality of contacts forwardly inserted into the corresponding cavities from the rear face, respectively, each of said contacts including:

a horizontal planar intermediate portion having two opposite side edges received in the corresponding pair of slits, respectively;

a pair of vertical arms extending vertically from two sides of the intermediate portion with a pair of tips received in the corresponding channels, respectively;

a central contact beam obliquely extending from the intermediate portion between said pair of contact beams; and a pair of resilient side arms horizontally extending from the pair of vertically arms, respectively, toward each other.

2. The connector as claimed in claim 1, wherein tips of said central contact beam and said pair of side arms are located close to each other.

3. The connector as claimed in claim 1, wherein said central contact beam extends rearwardly from a front portion of the intermediate portion.

4. The connector as claimed in claim 1, wherein said pair of side arms extend rearwardly.

5. The connector as claimed in claim 1, wherein said central contact beam is punched out of the intermediate portion between said pair of vertical arms so as to result in a corresponding opening in said intermediate portion.

6. The connector as claimed in claim 1, wherein said central contact beam and the pair of resilient side arms constitute three-point contact.

* * * * *